US008014706B2

(12) United States Patent
Nakayama et al.

(10) Patent No.: US 8,014,706 B2
(45) Date of Patent: Sep. 6, 2011

(54) DEVELOPING DEVICE, PROCESS CARTRIDGE, AND IMAGE FORMING APPARATUS

(75) Inventors: Masayoshi Nakayama, Tokyo (JP); Yoshitaka Fujinuma, Toyko (JP); Susumu Tateyama, Tokyo (JP); Tatsuya Kubo, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 583 days.

(21) Appl. No.: 12/036,640

(22) Filed: Feb. 25, 2008

(65) Prior Publication Data

US 2008/0213006 A1 Sep. 4, 2008

(30) Foreign Application Priority Data

Mar. 2, 2007 (JP) ..... 2007-052907

(51) Int. Cl.
*G03G 15/09* (2006.01)

(52) U.S. Cl. ..... 399/277

(58) Field of Classification Search ..... 399/149, 399/264, 276, 277

See application file for complete search history.

(56) References Cited

U.S. PATENT DOCUMENTS

| | | | | |
|---|---|---|---|---|
| 6,047,154 | A * | 4/2000 | Kawaguchi | 399/264 |
| 2007/0274742 | A1 | 11/2007 | Nakayama et al. | |
| 2007/0280744 | A1 | 12/2007 | Kubo et al. | |

FOREIGN PATENT DOCUMENTS

| | | |
|---|---|---|
| JP | 63-198065 | 12/1988 |
| JP | 4-42669 | 4/1992 |
| JP | 06-011970 | 1/1994 |
| JP | 06-230668 | 8/1994 |
| JP | 09-006139 | 1/1997 |

OTHER PUBLICATIONS

U.S. Appl. No. 12/060,606, filed Apr. 1, 2008, Nakayama, et al.

* cited by examiner

*Primary Examiner* — David M Gray
*Assistant Examiner* — Barnabas T Fekete
(74) *Attorney, Agent, or Firm* — Oblon, Spivak, McClelland, Maier & Neustadt, L.L.P.

(57) ABSTRACT

A developing device is disclosed. The developing device includes a developing roller disposed to face an image carrier and a toner carrier capturing roller disposed to face the developing roller for capturing toner carriers adhered onto the image carrier. The developing roller generates a magnetic pole at a side facing the toner carrier capturing roller. A first virtual line, which connects a rotational center of the developing roller to a rotational center of the toner carrier capturing roller, passes through a region between a position where a magnetic flux density of the magnetic pole in the normal line direction is minimum on the developing roller at the upstream side in the rotational direction of the developing roller and a position where the magnetic flux density of the magnetic pole in the normal line direction is maximum on the developing roller.

20 Claims, 8 Drawing Sheets

| ANGLE θ (DEGREE) | CARRIER TRANSFERABILITY | | |
|---|---|---|---|
| | No.1 | No.2 | No.3 |
| −0.53 | × | △ | × |
| 1.97 | ○ | ○ | ○ |
| 4.47 | ○ | ○ | ○ |
| 9.47 | ○ | ○ | ○ |
| 14.47 | ○ | ○ | ○ |

DEVELOPING DEVICE, PROCESS CARTRIDGE, AND IMAGE FORMING APPARATUS

BACKGROUND OF THE INVENTION

1. Field of the Invention

The present invention generally relates to a developing device, a process cartridge using the developing device, and an image forming apparatus using the process cartridge, which developing device provides a toner carrier capturing roller to capture toner carriers adhered onto an image carrier. The image forming apparatus is a copying machine, a printer, a facsimile machine, and a multifunctional peripheral providing the above functions, which image forming apparatus uses an electrophotographic system.

2. Description of the Related Art

Conventionally, in an image forming apparatus such as a copying machine and a printer, a toner carrier capturing roller (toner carrier capturing member) for magnetically capturing toner carriers adhered onto an image carrier such as a photosensitive drum has been provided in a developing device which contains a two-component developer formed of toners and toner carriers (refer to Patent Documents 1 through 3). The two-component developer may include an additive.

In detail, the developing device provides a developing roller (developer carrier) disposed to face the image carrier such as the photosensitive drum for carrying the developer. The developing roller provides a sleeve which rotates in a predetermined direction and a magnet fixed in the sleeve. A magnetic field is generated to form particle clusters (grain clusters of the developer) on the circumference surface of the developing roller (sleeve), and an image developing process is executed while the developer is carried in the sleeve rotating direction.

The toner carrier capturing roller is disposed at the downstream side of the developing roller in the developing roller rotating direction while facing the image carrier. The toner carrier capturing roller provides a sleeve which rotates in a predetermined direction and a magnet fixed in the sleeve. A magnetic field is generated on the circumference surface of the toner carrier capturing roller (sleeve) so as to capture the toner carriers adhered onto the image carrier. The toner carriers captured on the toner carrier capturing roller are mechanically scraped by a scraper which contacts the toner carrier capturing roller, and the scraped toner carriers are returned to the developing device.

The developing device prevents forming an abnormal image such as a whitened image and a lighting-bug like image on the image carrier caused by the adhesion of the toner carriers on the image carrier.

[Patent Document 1] Japanese Laid-Open Patent Application No. 6-11970

[Patent Document 2] Japanese Laid-Open Patent Application No. 9-6139

[Patent Document 3] Japanese Laid-Open Patent Application No. 6-230668

The developing device can capture the toner carriers adhered onto the image carrier; however, the load for the scraper which scrapes the toner carriers captured on the toner carrier capturing roller becomes large. Specifically, when the amount of the toner carriers captured by the toner carrier capturing roller becomes large, some toner carriers may not be scraped by the scraper, and in addition, the scraper and the toner carrier capturing roller may be worn out. In this case, an abnormal image may be formed.

Especially, in a high-speed image forming apparatus (having a high processing line speed), toner carriers carried by the developing roller are likely to be dropped from the surface of the developing roller, and the amount of the toner carriers to be adhered onto the image carrier is likely to be large.

SUMMARY OF THE INVENTION

In a preferred embodiment of the present invention, there is provided a developing device, a process cartridge using the developing device, and an image forming apparatus using the process cartridge in which the amount of toner carriers to be capture by a toner carrier capturing roller is not lowered with the passage of time.

Features and advantages of the present invention are set forth in the description that follows, and in part will become apparent from the description and the accompanying drawings, or may be learned by practice of the invention according to the teachings provided in the description. Features and advantages of the present invention will be realized and attained by a developing device, a process cartridge, and an image forming apparatus particularly pointed out in the specification in such full, clear, concise, and exact terms so as to enable a person having ordinary skill in the art to practice the invention.

To achieve one or more of these and other advantages, according to one aspect of the present invention, there is provided a developing device which contains developer having toner carriers and toners and develops a latent image formed on an image carrier. The developing device includes a developing roller disposed to face the image carrier for carrying the developer by a magnetic force, and a toner carrier capturing roller disposed to face the developing roller for capturing the toner carriers adhered onto the image carrier by a magnetic force. The developing roller generates a magnetic pole at a side facing the toner carrier capturing roller, and a first virtual line, which connects a rotational center of the developing roller to a rotational center of the toner carrier capturing roller, passes through a region between a position where a magnetic flux density of the magnetic pole in the normal line direction is minimum on the developing roller at the upstream side in the rotational direction of the developing roller and a position where the magnetic flux density of the magnetic pole in the normal line direction is maximum on the developing roller.

According to another aspect of the present invention, there is provided a process cartridge detachable from a main body of an image forming apparatus. The process cartridge includes an image carrier on which a latent image is formed and a developing device which contains developer having toner carriers and toners and develops the latent image formed on the image carrier. The developing device includes a developing roller disposed to face the image carrier for carrying the developer by a magnetic force, and a toner carrier capturing roller disposed to face the developing roller for capturing the toner carriers adhered onto the image carrier by a magnetic force. The developing roller generates a magnetic pole at a side facing the toner carrier capturing roller, and a first virtual line, which connects a rotational center of the developing roller to a rotational center of the toner carrier capturing roller, passes through a region between a position where a magnetic flux density of the magnetic pole in the normal line direction is minimum on the developing roller at the upstream side in the rotational direction of the developing roller and a position where the magnetic flux density of the magnetic pole in the normal line direction is maximum on the developing roller.

According to another aspect of the present invention, there is provided an image forming apparatus which forms an image on a recording medium. The image forming apparatus includes a process cartridge detachable from a main body of the image forming apparatus. The process cartridge includes an image carrier on which a latent image is formed, and a developing device which contains developer having toner carriers and toners and develops the latent image formed on the image carrier. The developing device includes a developing roller disposed to face the image carrier for carrying the developer by a magnetic force, and a toner carrier capturing roller disposed to face the developing roller for capturing the toner carriers adhered onto the image carrier by a magnetic force. The developing roller generates a magnetic pole at a side facing the toner carrier capturing roller, and a first virtual line, which connects a rotational center of the developing roller to a rotational center of the toner carrier capturing roller, passes through a region between a position where a magnetic flux density of the magnetic pole in the normal line direction is minimum on the developing roller at the upstream side in the rotational direction of the developing roller and a position where the magnetic flux density of the magnetic pole in the normal line direction is maximum on the developing roller.

EFFECT OF THE INVENTION

According to an embodiment of the present invention, in a developing device, since the position of a toner carrier capturing roller is optimized for the position of a developing roller, developer (toner carriers) captured by the toner carrier capturing roller is smoothly transferred onto the developing roller by a magnetic pole generated by the developing roller. Therefore, lowering the amount of the developer to be captured by the toner carrier capturing roller with the passage of time can be surely prevented.

BRIEF DESCRIPTION OF THE DRAWINGS

Features and advantages of the present invention will become more apparent from the following detailed description when read in conjunction with the accompanying drawings, in which.

DESCRIPTION OF THE PREFERRED EMBODIMENTS

[Best Mode of Carrying Out the Invention]

The best mode of carrying out the present invention is described with reference to the accompanying drawings.

First Embodiment

Referring to FIGS. 1 through 9, a first embodiment of the present invention is described.

Figure 1:
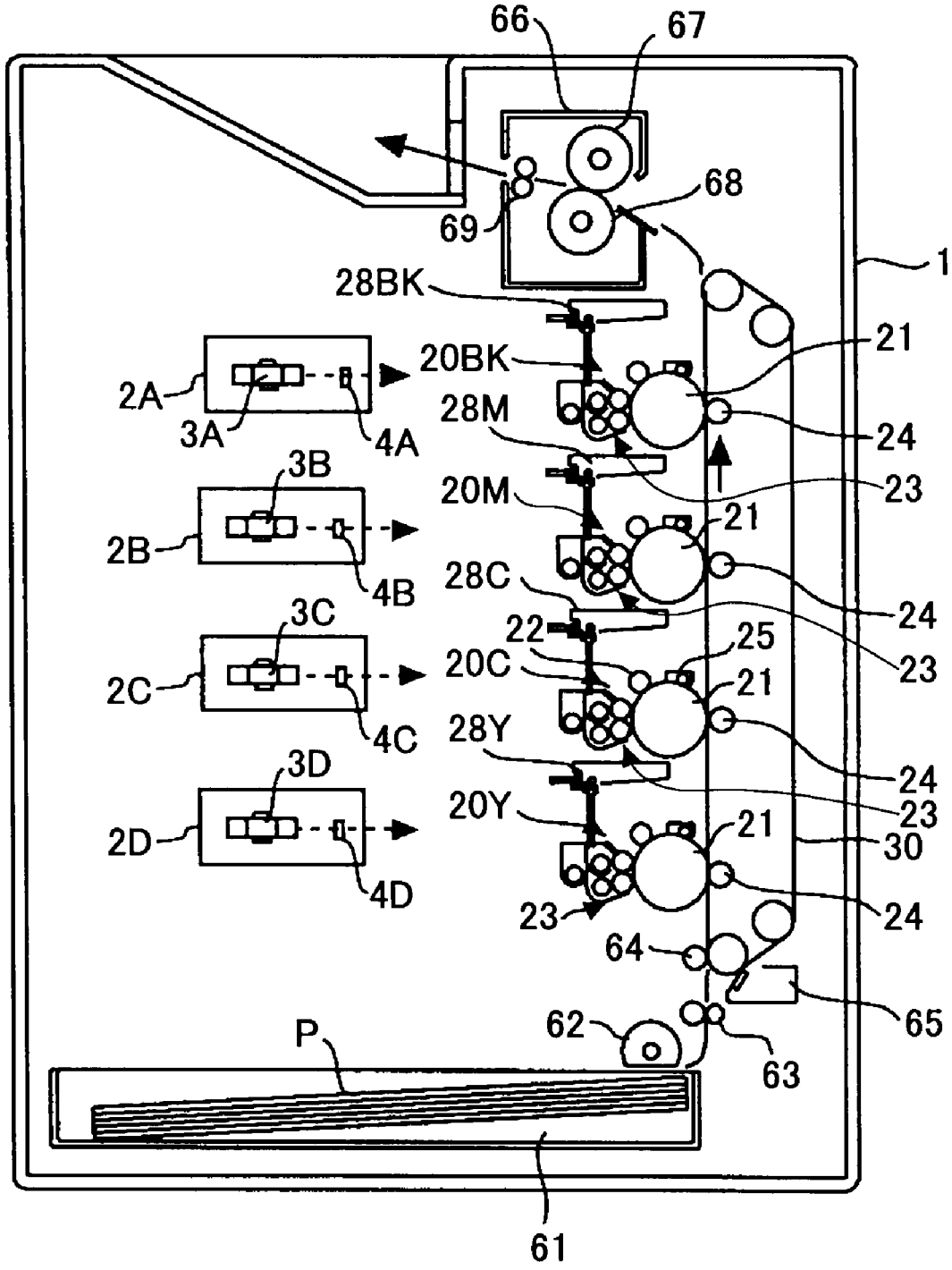
FIG. 1 is a cut-away side view of an image forming apparatus according to a first embodiment of the present invention.

FIG. 1 is a cut-away side view of an image forming apparatus 1 according to the first embodiment of the present invention.

In FIG. 1, writing sections 2A through 2D write corresponding electrostatic latent images on corresponding photosensitive drums 21 (image carriers) which are charged based on image information. The writing sections 2A through 2D are optical scanning devices including corresponding polygon mirrors 3A through 3D and corresponding optical elements 4A through 4D. The writing sections 2A through 2D can be formed of LED arrays instead of using the optical scanning devices.

A paper feeding section 61 stores a recording medium P such as recording paper and an OHP sheet, and feeds the recording medium P to a transfer belt 30 when an image is to be formed on the recording medium P.

The transfer belt 30 is an endless belt which transfers toner images formed on the photosensitive drums 21 onto the recording medium P by electrostatically adhering the recording medium P onto the surface of the transfer belt 30. An adhering roller 64 and a belt cleaner 65 are disposed to contact the outer circumference surface of the transfer belt 30.

Each of transfer rollers 24 facing the corresponding photosensitive drums 21 via the transfer belt 30 includes a core metal member and a conductive elastic layer for covering the core metal member. The conductive elastic layer is an elastic body whose electric resistance value (volume resistivity) is adjusted to be a medium resistance value by blending a conductive agent such as carbon black, zinc oxide, and tin oxide with an elastic body such as polyurethane rubber, and ethylene propylene diene monomer (EPDM) rubber.

A fixing section 66 includes a pressure applying roller 67 and a heat applying roller 68, and the toner image on the recording medium P is fixed by the applied pressure and heat.

Process cartridges 20Y, 20C, 20M, and 20BK disposed in the vertical direction along the transfer belt 30 form a yellow toner image, a cyan toner image, a magenta toner image, and a black toner image on the corresponding photosensitive drums 21, respectively. The structure of each of the process cartridges 20Y, 20C, 20M, and 20BK is described below.

On the process cartridges 20Y, 20C, 20M, and 20BK, corresponding agent cartridges 28Y, 28C, 28M, and 28BK are disposed, respectively, for supplying the corresponding yellow toners, cyan toners, magenta toners, and black toners with toner carriers (magnetic carriers) to corresponding developing devices 23.

The process cartridges 20Y, 20C, 20M, and 20BK, and the agent cartridges 28Y, 28C, 28M, and 28BK are detachable from the image forming apparatus 1 by moving the transfer belt 30 with a rotating shaft (not shown) of the transfer belt 30 as the center.

The image forming apparatus 1 is an MFP (multifunctional peripheral) including a copying machine and a printer. When the MFP is used as the copying machine, image data read by a scanner are converted into copying data by image processes such as an AD (analog to digital) conversion process, an MTF (modulation transfer function) correction process, and a tone process being applied to the read image data. When the MFP is used as the printer, image data having formats such as a PDL (page description language) format and a bitmap format transmitted from devices such as a computer are converted into printing data by image processes being applied to the transmitted image data.

When an image is formed, exposure light corresponding to image data of black, magenta, cyan, and yellow is irradiated to the corresponding process cartridges 20BK, 20M, 20C, and 20Y from the corresponding writing sections 2A, 2B, 2C, and 2D. That is, the exposure light (laser beams) from corresponding light sources (not shown) is irradiated on the corresponding photosensitive drums 21 via the corresponding polygon mirrors 3A, 3B, 3C, and 3D, and the corresponding optical elements 4A, 4B, 4C, and 4D. With this, toner images corresponding to the exposure light are formed on the corresponding photosensitive drums 21 (image carriers) of the corresponding process cartridges 20BK, 20M, 20C, and 20Y. Then the formed toner images are transferred onto the recording medium P via the transfer belt 30.

The recording medium P fed from the paper feeding section 61 is carried to the transfer belt 30 by the timing being matched at the position of a registration roller 63.

The adhering roller 64 positioned at the entrance of the transfer belt 30 adheres the recording medium P onto the transfer belt 30 by applying a voltage. The recording medium P is carried by the transfer belt 30 in the arrow direction and passes through the process cartridges 20Y, 20C, 20M, and 20BK, and the toner images of the four colors are superposed on the recording medium P.

The recording medium P on which the color tone image is formed is separated from the transfer belt 30 and is input to the fixing section 66. The toner image on the recording medium P is fixed at the fixing section 66 by pressure and heat being applied by the pressure applying roller 67 and the heat applying roller 68 while the recording medium P is sandwiched between the rollers 67 and 68. The transfer belt 30 separated from the recording medium P reaches the belt cleaner 65, and dust such as remaining toners adhered onto the surface of the transfer belt 30 is removed.

Elements of the reference numbers 22, 25, 62, and 69 shown in FIG. 1 are described below.

[Process Cartridge and Agent Cartridge]

Next, the process cartridges 20Y, 20C, 20M, and 20BK, and the agent cartridges 28Y, 28C, 28M, and 28BK are described in detail.

Since the structures of the process cartridges 20Y, 20C, 20M, and 20BK are almost identical to each other, and the structures of the agent cartridges 28Y, 28C, 28M, and 28BK are almost identical to each other; therefore, in the following, in some cases, the suffixes Y, M, C, and BK are omitted. In addition, the structures of the writing sections 2A, 2B, 2C, and 2D are almost identical to each other; therefore, in the following, in some cases, the suffixes A, B, C, and D are omitted. That is, when a suffix for color is not attached to a reference number of an element, the reference number represents the set of elements.

Figure 2:
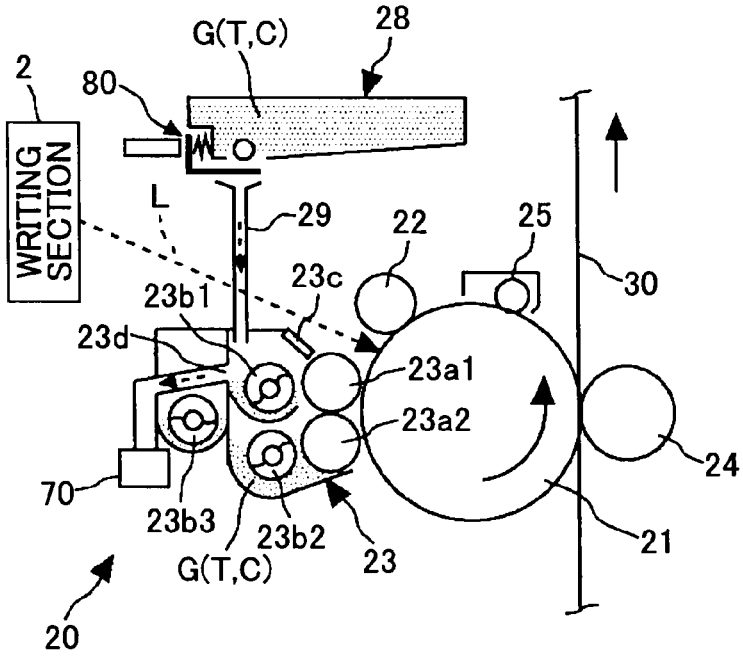
FIG. 2 is a cut-away side view of a part of the image forming apparatus shown in FIG. 1.
Figure 3:
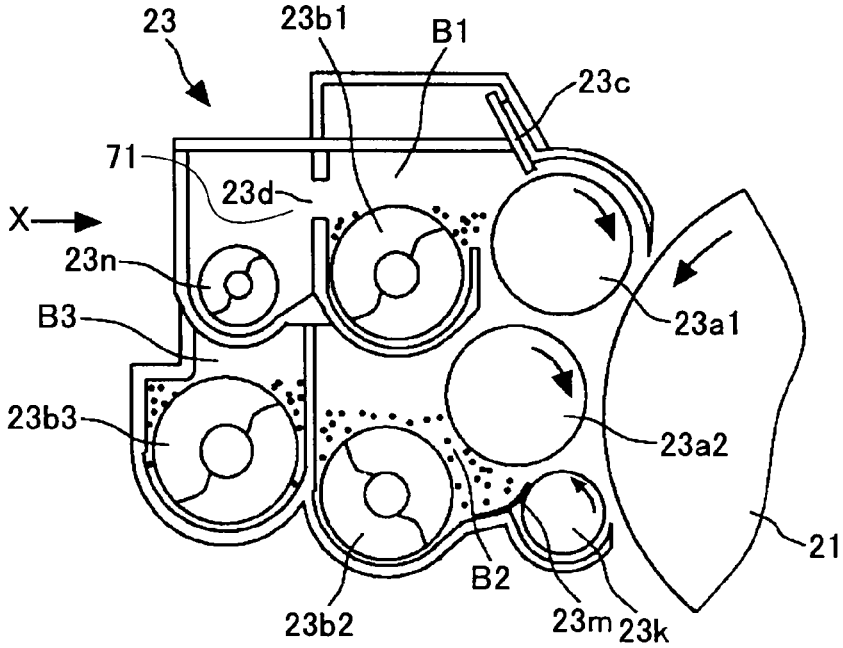
FIG. 3 is an enlarged view of a developing device disposed in a process cartridge shown in FIG. 1.
Figure 4:
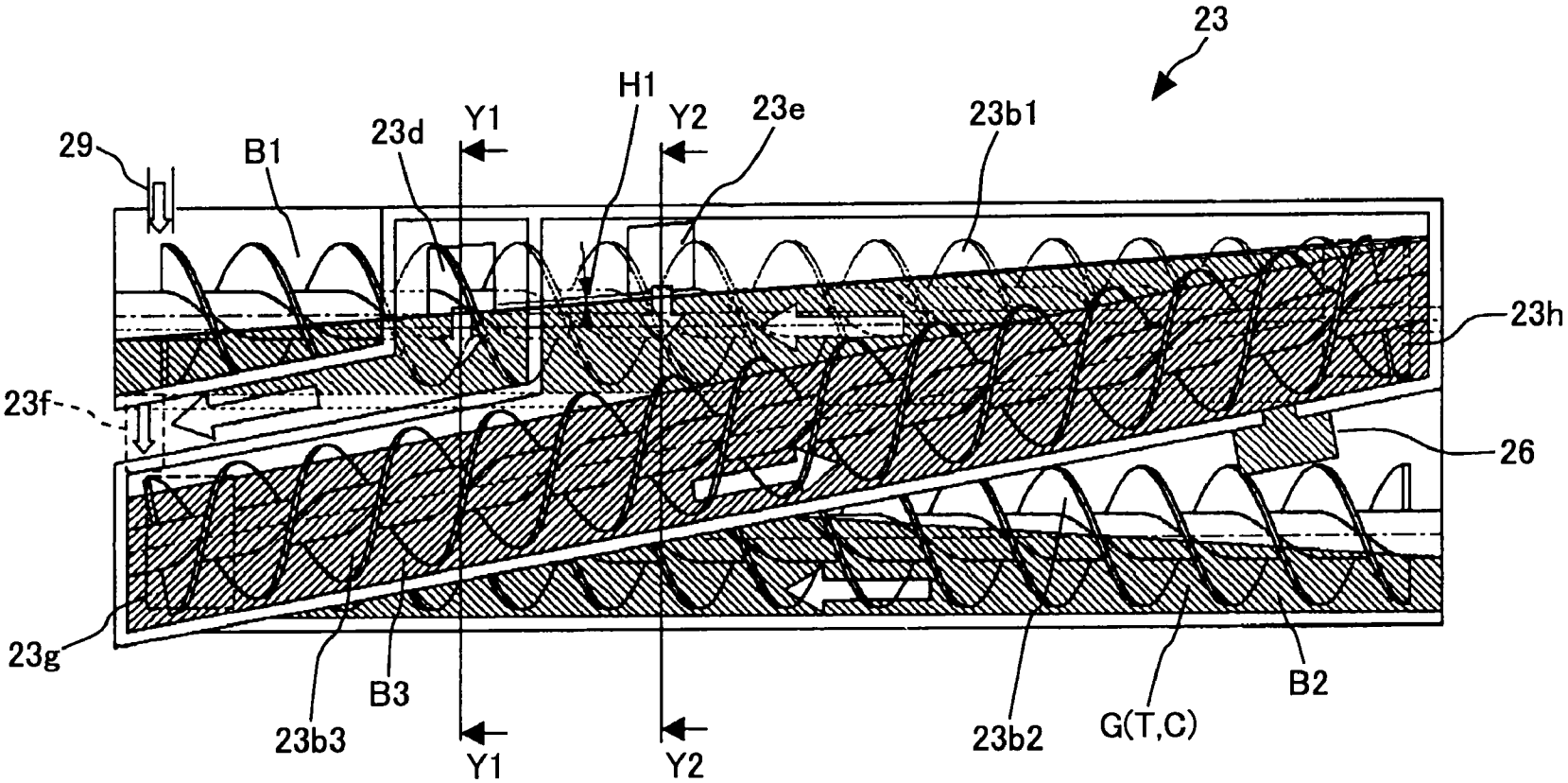
FIG. 4 is a cut-away side view of the developing device taken from the X direction shown in FIG. 3.
Figure 5:
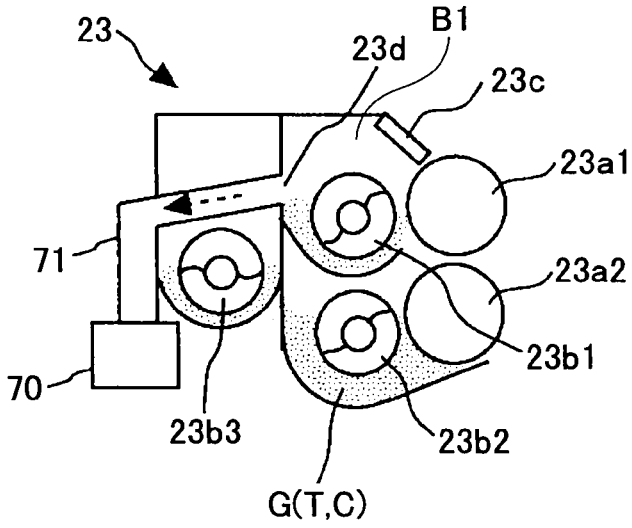
FIG. 5 is a cross-sectional view of the developing device along line Y1-Y1 of FIG. 4.
Figure 6:
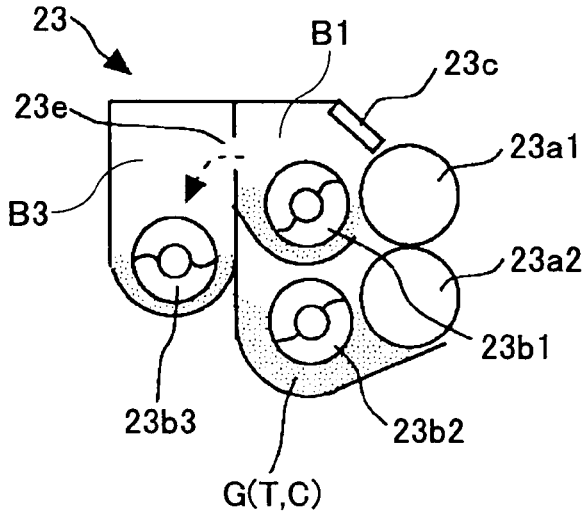
FIG. 6 is a cross-sectional view of the developing device along line Y2-Y2 of FIG. 4.

FIG. 2 is a cut-away side view of a part of the image forming apparatus 1 according to the first embodiment of the present invention. In FIG. 2, mainly, parts of the process cartridge 20 and the agent cartridge 28 are enlarged. In addition, in FIG. 2, developer G which contains toners T and toner carriers C is shown. FIG. 3 is an enlarged view of the developing device 23 disposed in the process cartridge 20. FIG. 4 is a cut-away side view of the developing device 23 taken from the X direction shown in FIG. 3. In FIG. 4, circulating routes of the developer G are shown by white arrows. In addition, FIG. 4 shows the long length direction of the developing device 23. FIG. 5 is a cross-sectional view of the developing device 23 along line Y1-Y1 of FIG. 4. FIG. 6 is a cross-sectional view of the developing device 23 along line Y2-Y2 of FIG. 4.

As shown in FIG. 2, the process cartridge 20 is integrally formed of the photosensitive drum 21 (image carrier), a charging section 22, the developing device 23, and a cleaning section 25. The process cartridge 20 uses a trickle developing system in which the developer G is properly supplied to the process cartridge 20 and is properly discharged from the process cartridge 20.

In some cases, the process cartridge 20 can be integrally formed of the photosensitive drum 21 and at least any one of the charging section 22, the developing device 23, and the cleaning section 25.

The photosensitive drum 21 is a negatively charged organic photosensitive drum and is rotated counterclockwise by a rotation driving mechanism (not shown).

The charging section 22 is an elastic charging roller formed by applying a layer having a middle resistance value, for example, a urethane foam layer having a middle resistance value onto a core metal member. The urethane foam layer having the middle resistance value is formed of materials such as urethane resin, carbon black (conductive particles), a sulfating agent, and a foaming agent. The layer having the middle resistance value can be formed of a rubber material, in which a conductive material such as carbon black and a metal oxide for adjusting the resistance value is dispersed in EPDM rubber, acrylonitrile butadiene rubber (NBR), silicone rubber, or isoprene rubber, or formed of the foamed rubber material.

The cleaning section 25 includes a cleaning brush (cleaning blade) (not shown) contacting the surface of the photosensitive drum 21, and the cleaning brush mechanically removes and collects the toners T remaining on the photosensitive drum 21.

The developing device 23 includes first and second developing rollers 23*a*1 and 23*a*2 (developer carriers) to face the photosensitive drum 21. A developing region, where the photosensitive drum 21 contacts magnetic brushes of the developer G (not shown) formed on the first and second developing rollers 23*a*1 and 23*a*2, is formed at a position where the first and second developing rollers 23*a*1 and 23*a*2 face the photosensitive drum 21. The developing device 23 contains the developer G (two-component developer) formed of the toners T and the toner carriers C. The developing device 23 develops an electrostatic latent image formed on the photosensitive drum 21 and forms a toner image. The structure and operations of the developing device 23 are described below in detail.

Since the developing device 23 uses the trickle developing system, new developer G is properly supplied to the developing device 23 from the agent cartridge 28, and degraded developer G is discharged to an agent storing container 70 disposed outside the developing device 23.

The agent cartridge 28 stores the developer G so that the agent G is supplied to the developing device 23. That is, the agent cartridge 28 supplies new toners T and new toner carriers C to the developing device 23. Specifically, the agent cartridge 28 properly supplies the developer G to the developing device 23 by opening or closing a shutter 80, based on toner concentration information (toner ratio in the developer G) detected by a magnetic sensor 26 (refer to FIG. 4) disposed in the developing device 23.

In the first embodiment of the present invention, it is determined that the toner concentration (the ratio of the toners T to the toner carriers C in the developer G) is relatively high.

The developer G from the agent cartridge 28 is supplied to the developing device 23 via a supplying pipe 29.

[Image Forming Processes]

Next, referring to FIG. 2, image forming processes on the photosensitive drum 21 are described.

When the photosensitive drum 21 is rotated counterclockwise, the surface of the photosensitive drum 21 is uniformly charged by the charging section 22. Then the charged surface of the photosensitive drum 21 reaches a position where exposure light L irradiates, and an exposure process is executed by the writing section 2. That is, the charged surface of the photosensitive drum 21 is selectively discharged corresponding to image data by the irradiated exposure light L, and an electrostatic latent image is formed on the surface of the photosensitive drum 21 by generating a potential difference (potential contrast) between an exposure light irradiated part and an exposure light not irradiated part. In the exposure process, an electric charge generating material in a photosensitive layer of the photosensitive drum 21 generates an electric charge when receiving the exposure light L, and the electric charge negates a part of the charged surface of the photosensitive drum 21.

Then the surface of the photosensitive drum 21 where the electrostatic latent image is formed reaches a position to face the developing device 23. The electrostatic latent image on the surface of the photosensitive drum 21 contacts the magnetic brushes on the first and second developing roller 23*a*1 and 23*a*2, and toners T negatively charged in the magnetic brushes are adhered onto the surface of the photosensitive drum 21 and a toner image becomes visible.

In detail, the amount of the developer G attracted by a magnetic force of the magnet of the first developing roller 23*a*1 is made to be a suitable amount by a doctor blade 23*c*, and the suitable amount of the developer G is carried to the developing region facing the photosensitive drum 21. As described above, at the developing region, the first and second developing rollers 23*a*1 and 23*a*2 face the photosensitive drum 21. The particle clusters of the toner carriers C rub the surface of the photosensitive drum 21 at the developing region. The toners T mixed with the toner carriers C in the developer G are negatively charged by rubbing against the toner carriers C. At this time, the toner carriers C are positively charged. A predetermined bias voltage is applied to the first and second developing rollers 23*a*1 and 23*a*2 from a power source (not shown). With this, an electric field is generated between the first and second developing rollers 23*a*1 and 23*a*2 and the photosensitive drum 21, and a toner image is formed on the surface of the photosensitive drum 21 by selectively adhering the negatively charged toners T onto the surface of the photosensitive drum 21 with the generated electric field.

Then the surface of the photosensitive drum 21 on which the toner image is formed reaches a position where the photosensitive drum 21 faces the transfer belt 30 and the transfer roller 24. The toner image on the surface of the photosensitive drum 21 is transferred onto the recording medium P which is carried to the position by matching the timing. At this time, a predetermined voltage is applied to the transfer roller 24. The recording medium P on which the toner image is formed is passed through the fixing section 66 and is output from the image forming apparatus 1 by outputting rollers 69 (refer to FIG. 1).

Then the surface of the photosensitive drum 21 reach the cleaning section 25, and the cleaning section 25 removes and collects remaining toners T on the surface of the photosensitive drum 21.

Then the surface of the photosensitive drum 21 is passed through a discharging section (not shown) and the image forming processes end.

Elements of the reference numbers 23*b*1, 23*b*2, 23*b*3, and 23*d* shown in FIG. 2 are described below.

[Structure and Operations of Developing Device]

Next, referring to FIG. 3, the structure and operations of the developing device 23 are described. As shown in FIG. 3, the developing device 23 includes the first and second developing rollers 23*a*1 and 23*a*2 (developer carriers), first through third developer carrying screws 23*b*1, 23*b*2, and 23*b*3 (auger screws), the doctor blade 23*c*, a toner carrier capturing roller 23*k*, a scraper 23*m*, and a toner carrier discharging screw 23*n*. In addition, in the developing device 23, first through third developer carrying sections B1, B2, and B3 which form a circulating route of the developer G are formed.

The first and second developing rollers 23*a*1 and 23*a*2 are cylindrical sleeves formed of nonmagnetic materials such as aluminum, brass, stainless steel, and conductive resin, and are rotated clockwise by a rotation driving mechanism (not shown). In each of the first and second developing rollers 23*a*1 and 23*a*2, a magnet (not shown) is fixed for generating a magnetic field to form particle clusters of the developer G on the circumference surface of each of the first and second developing rollers 23*a*1 and 23*a*2. The toner carriers C in the developer G form chain-shaped particle clusters on the first and second developing rollers 23*a*1 and 23*a*2 along the normal line direction of the magnetic force of the magnet. A magnetic brush is formed by adhering the charged toners T onto the toner carriers C of the chain-shaped particle clusters. The magnetic brush is moved clockwise in the same moving direction as the rotational direction of the first and second developing rollers 23*a*1 and 23*a*2.

As described above, the doctor blade 23*c*, disposed at the upstream side of the developing region, makes the amount of the developer G on the first developing roller 23*a*1 a suitable amount.

The first through third developer carrying screws 23*b*1, 23*b*2, and 23*b*3 stir the developer G in the developing device 23 while circulating the developer G in the long length direction (the direction perpendicular to the plane of the paper of FIG. 3).

The first developer carrying screw 23*b*1 (first developer carrying member) is disposed in the first developer carrying section B1, faces the first developing roller 23*a*1, and horizontally carries the developer G onto the first developing roller 23*a*1. That is, the first developer carrying section B1 faces the first developing roller 23*a*1, and supplies the developer G to the first developing roller 23*a*1 while carrying the developer G in the rotating shaft direction of the first developing roller 23*a*1 (the direction perpendicular to the plane of the paper of FIG. 3).

The second developer carrying screw 23*b*2 (second developer carrying member) is disposed in the second developer carrying section B2, faces the second developing roller 23*a*2 disposed under the first developing roller 23*a*1, and horizontally carries the developer G dropped from the second developing roller 23*a*2. The dropped developer G is the developer G which remains on the second developing roller 23*a*2 after the developing process and is forcibly dropped from the second developing roller 23*a*2 by a developer drawing apart pole (described below). That is, the second developer carrying section B2 is disposed under the first developer carrying section B1 by facing the second developing roller 23*a*2, and carries the dropped developer G in the rotating shaft direction of the second developing roller 23*a*2 (the direction perpendicular to the plane of the paper of FIG. 3).

The first and second developer carrying screws 23*b*1 and 23*b*2 are disposed so that their rotating shafts are almost horizontal, similar to the rotating shafts of the first and second developing rollers 23*a*1 and 23*a*2 and the photosensitive drum 21.

The third developer carrying screw 23*b*3 (third developer carrying member) is disposed in the third developer carrying section B3. The third developer carrying screw 23*b*3 is disposed slanted from the horizontal direction so that the downstream side of the developer carrying route of the second developer carrying screw 23*b*2 linearly connects to the upstream side of the developer carrying route of the first developer carrying screw 23*b*1 (refer to FIG. 4).

The third developer carrying screw 23*b*3 carries the developer G carried by the second developer carrying screw 23*b*2 to the upstream side of the developer carrying route of the first developer carrying screw 23*b*1. In addition, the third developer carrying screw 23*b*3 carries the developer G circulated from the downstream side of the carrying route of the first developer carrying screw 23*b*1 to the upstream side of the carrying route of the first developer carrying screw 23*b*1 via a dropping route 23*f* (refer to FIG. 4). That is, the third developer carrying section B3 carries the developer G carried by the second developer carrying section B2 to the upstream side of the first developer carrying section B1, and carries the developer G reached at the downstream side of the first developer carrying section B1 to the upstream side of the first developer carrying section B1.

The developer carrying route (the first developer carrying section B1) by the first developer carrying screw 23*b*1, the developer carrying route (the second developer carrying section B2) by the second developer carrying screw 23*b*2, and the developer carrying route (the third developer carrying section B3) by the third developer carrying screw 23*b*3 are partitioned by walls.

As shown in FIG. 4, the downstream side of the second developer carrying section B2 is connected to the upstream side of the third developer carrying section B3 via a first relaying section 23*g*. In addition, the downstream side of the third developer carrying section B3 is connected to the upstream side of the first developer carrying section B1 via a second relaying section 23*h*. Further, the downstream side of the first developer carrying section B1 is connected to the upstream side of the third developer carrying section B3 via the dropping route 23*f*.

By the first through third developer carrying sections B1 through B3 (the first through third developer carrying screws 23*b*1 through 23*b*3), the route circulating the developer G in the long length direction shown in FIG. 4 is formed in the developing device 23. When the developing device 23 is driven, the developer G flows in conditions shown by oblique lines of FIG. 4 (in the white arrow directions).

In FIG. 4, in the first developer carrying section B1, in order to supply a part of the developer G which is being carried to the first developing roller 23*a*1, the level of the developer G at the downstream side is lower than that at the upstream side. The developer G which is not supplied to the first developing roller 23*a*1 flows into the upstream side of the third developer carrying section B3 via the dropping route 23*f*.

As described above, the magnetic sensor 26 for detecting the toner concentration is disposed at the third developer carrying section B3. The agent cartridge 28 supplies the developer G having predetermined concentration to the developing device 23, based on toner concentration information detected by the magnetic sensor 26. In the first embodiment of the present invention, the toner concentration of the developer G in the developing device 23 is controlled to be 4 to 7 wt %.

In FIGS. 3 through 5, the first developer carrying section B1 includes an outlet 23*d* (discharging section) for discharging a part of the developer G stored in the developing device 23 to the agent storing container 70. In detail, when the surface of the developer G in the developing device 23 exceeds a predetermined level by being supplied from the agent cartridge 28 via the supplying pipe 29 (refer to FIG. 2), the surplus developer G is discharged to the agent storing container 70 via the outlet 23*d*. That is, when the surface of the developer G exceeds the lower part of the outlet 23*d*, the surplus developer G is dropped by its own weight into the agent storing container 70 from the outlet 23*d* via a discharging route 71. That is, the developer G (the toner carriers C) contaminated or degraded by the resin of the toners T or an additive is automatically discharged to the outside. Because the concentration of the contaminated developer G is lower than a predetermined value, the weight of the contaminated developer G is lower than a predetermined weight. Therefore, the degradation of image quality can be prevented with the passage of time.

The toner carrier discharging screw 23*n* (refer to FIG. 3) for horizontally carrying the developer G discharged from the outlet 23*d* is disposed in the discharging route 71.

In addition, in order to return a part of the developer G to the upstream side of the circulating route by not discharging from the outlet 23*d*, a bypass route is formed in the circulating route of the developer G in the developing device 23. Specifically, as shown in FIGS. 4 and 6, an opening section 23*e* is formed in the first developer carrying section B1 at the upstream side of the outlet 23*d* (relatively near position to the outlet 23*d*). The opening section 23*e* is the entrance of the bypass route and the exit (not shown) of the bypass route is disposed in the third developer carrying section B3 (at almost a center position in the long length direction). In FIG. 4, the opening section 23*e* is viewed in the third developer carrying section B3; however, as shown in FIG. 6, the opening section 23*e* is in the first developer carrying section B1.

Since the bypass route of the developer G is formed in the developer circulating route of the developing device 23, even if a wave-shaped bias is formed in the developer G and the dispersion of the amount of the developer G to be discharged from the outlet 23*d* occurs in the developing device 23, the developer G over the necessary amount is prevented from being discharged from the developing device 23.

Figure 7:
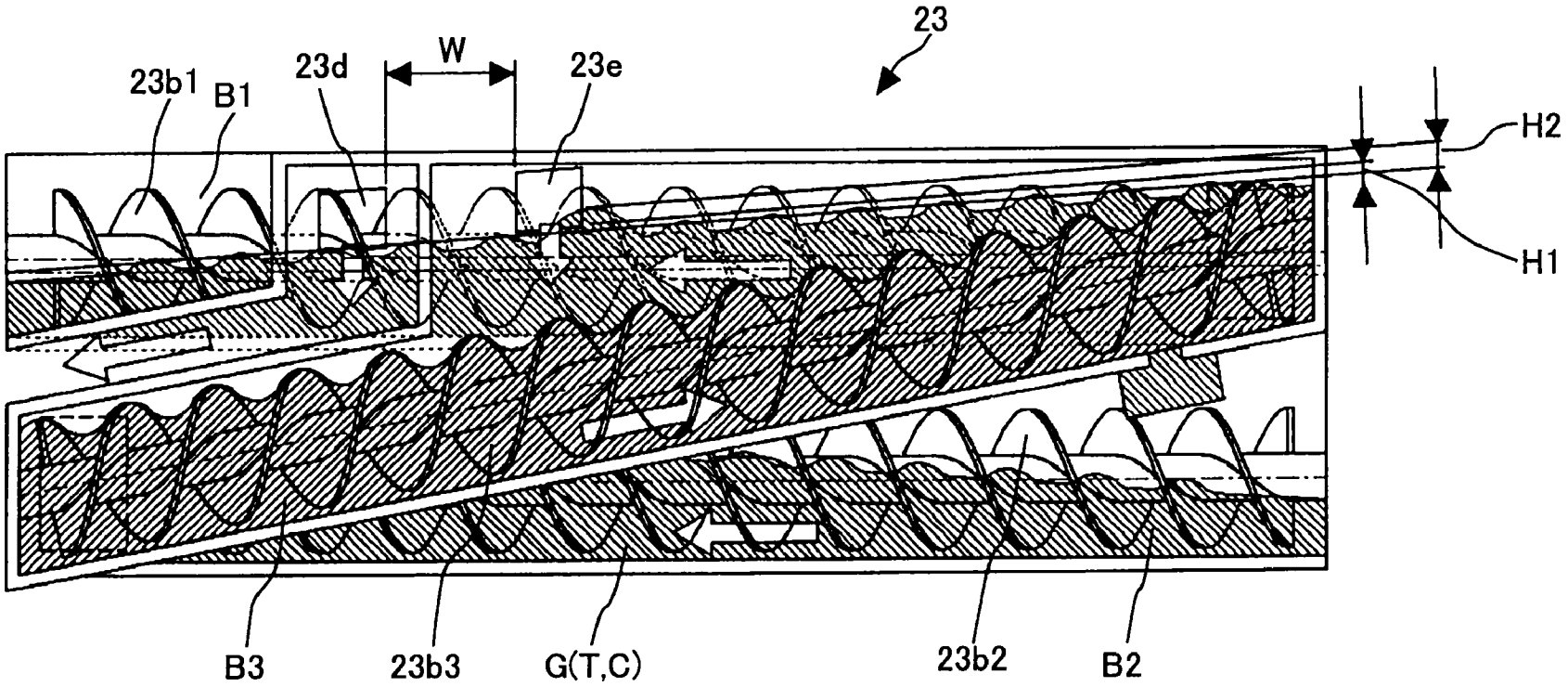
FIG. 7 is a cut-away side view of the developing device shown in FIG. 4 in which a wave-shaped bias of developer occurs in a circulating route of the developer.

FIG. 7 is a cut-away side view of the developing device 23 shown in FIG. 4 in which the wave-shaped bias of the developer G occurs in the circulating route of the developer G. As shown in FIG. 7, in some cases, the wave-shaped bias whose height difference is large may occur in the circulating route of the developer G. The wave-shaped bias of the developer G remarkably appears soon after the developing device 23 is driven.

Conventionally, when the wave-shaped bias occurs in the developer G, all the developer G positioned over the lower part of the outlet 23*d* (the developer G of the height H2 shown in FIG. 7) is discharged from the outlet 23*d*. Normally, it is not necessary to discharge the above developer G; however, when the developer G is repeatedly discharged, the developer G in the developing device 23 runs short. Consequently, the conditions of the developer G may become unstable (degraded), the charging amount of the toners T may become low, and the image density of the output image may be lowered.

In the first embodiment of the present invention, since the opening section 23*e* connecting to the bypass route is disposed at the upstream side of the outlet 23*d*, a part of the developer G at the position over the lower part of the outlet 23*d* is not discharged from the outlet 23*d* and is returned to the developer carrying route of the third developer carrying screw 23*b*3 via the opening section 23*e*. Therefore, the developer G is not excessively discharged from the outlet 23*d*.

As shown in FIG. 7, the height of the lower part of the opening section 23*e* is higher than the lower part of the outlet 23*d* by the height H1.

Of the developer G at the position higher than the lower part of the outlet 23*d*, the part of the developer G at the height H2-H1 is not discharged from the outlet 23*d* and is returned to the developer carrying route of the third developer carrying screw 23*b*3 via the opening section 23*e*. With this, excessively discharging the developer G from the outlet 23*d* can be prevented while maintaining the function of the outlet 23*d*. In this, it is preferable that the distance W between the outlet 23*d* and the opening section 23*e* in the long length direction be as short as possible.

Returning to FIG. 3, the toner carrier capturing roller 23*k* is disposed under the second developing roller 23*a*2 to face the photosensitive drum 21 at the downstream side in the rotating direction of the second developing roller 23*a*2. The scraper 23*m* is disposed to contact the toner carrier capturing roller 23*k*.

The toner carrier capturing roller 23*k* is formed of a cylinder made of, for example, stainless steel in which a magnet for generating a predetermined magnetic field is fixed. The toner carrier capturing roller 23 captures the toner carriers C adhered onto the photosensitive drum 21 which toner carriers C have been moved from the developing device 23. The toner carrier capturing roller 23 is rotated counterclockwise.

Almost all the toner carriers C captured by the toner carrier capturing roller 23*k* are transferred onto the second developing roller 23*a*2 at the position facing the second developing roller 23*a*2, and the transferred toner carriers C are dropped from the second developing roller 23*a*2 at the carrier dropping position (at the developer drawing apart polar position) and the dropped toner carriers T are collected in the second developer carrying section B2. A part of the toner carriers C which remains on the toner carrier capturing roller 23*k* without moving onto the second developing roller 23*a*2 is mechanically scraped by the scraper 23*m*, and the scraped toner carriers C are collected in the second developer carrying section B2.

Since the toner carrier capturing roller 23*k* is disposed in the developing device 23, the toner carriers C adhered onto the photosensitive drum 21 can be removed from the photosensitive drum 21. Therefore, an abnormal image (whitened image and lighting-bug like image) can be prevented.

In the first embodiment of the present invention, the outer diameter of each of the first and second developing rollers 23*a*1 and 23*a*2 is approximately 30 mm, the linear velocity of each outer circumference surface of the first and second developing rollers 23*a*1 and 23*a*2 is approximately 748 mm/s, the outer diameter of the toner carrier capturing roller 23*k* is approximately 16 mm, the linear velocity of the outer circumference surface of the toner carrier capturing roller 23*k* is approximately 10.6 mm/s, and the process linear velocity (the linear velocity of the outer circumference surface of the photosensitive drum 21 and the carrying velocity of the recording medium P) is approximately 440 mm/s.

In the first embodiment of the present invention, the grain diameter (particle diameter) of the toner carriers C is approximately 55 μm, the saturated magnetization of the toner carriers C is approximately 96 emu/g, and the grain diameter of the toners T is approximately 6.8 μm.

[Second Developing Roller and Toner Carrier Capturing Roller]

Next, the second developing roller 23*a*2 and the toner carrier capturing roller 23*k* are described in detail.

Figures 8, 9:
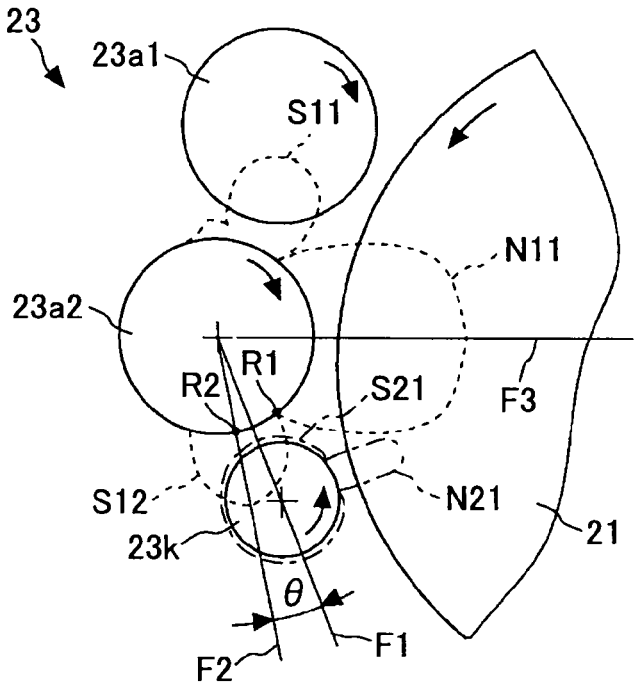
FIG. 8 is an enlarged view of a part of the developing device shown in FIG. 1.
FIG. 9 is a table showing the results of an experiment in which a relationship between carrier transferability and an angle θ is shown according to the first embodiment of the present invention.

FIG. 8 is an enlarged view of a part of the developing device 23. In FIG. 8, the positions of the magnetic force distributions (magnetic flux densities in the normal line direction) of the second developing roller 23*a*2 and the toner carrier capturing roller 23*k* are shown.

As shown in FIG. 8, first, second, and third magnetic poles S11, N11, S12 are generated at positions surrounding the second developing roller 23*a*2 by the built-in magnet. The first magnetic pole S11 is a developer carrying magnetic pole (S pole) generated at the side to face the first developing roller 23*a*1 and carries the developer G on the first developing roller 23*a*1 onto the second developing roller 23*a*2. The second magnetic pole N11 is a main magnetic pole (N pole) generated at the side to face the photosensitive drum 21, forms particle clusters of the developer G on the second developing roller 23*a*2, and develops an electrostatic latent image on the photosensitive drum 21.

The third magnetic pole S12 is a developer carrying magnetic pole (S pole) generated at the side to face the carrier capturing drum 23*k* and carries the remaining developer G after the developing process to the developer drawing apart pole (not shown) and transfers the developer G captured by the toner carrier capturing roller 23*k* onto the second developing roller 23*a*2. In addition, a fourth magnetic pole (not shown) is generated. The fourth magnetic pole is the developer drawing apart pole having a minimum magnetic force generated at the downstream side of the third magnetic pole S12 between the first magnetic pole S11 and the third magnetic pole S12, and collects the remaining developer G after the developing process in the second developer carrying section B2.

The maximum value (peak magnetic force) of the magnetic flux density in the normal line direction of the first magnetic pole S11 is approximately 600 gausses, and the magnetized width (width expressed by an angle in which the magnetic force is 80% of the peak magnetic force) of the first magnetic pole S11 is approximately 26.5 degrees. The maximum value of the magnetic flux density in the normal line direction of the second magnetic pole N11 is approximately 1150 gausses, and the magnetized width of the second magnetic pole N11 is approximately 29 degrees. The maximum value of the magnetic flux density in the normal line direction of the third magnetic pole S12 is approximately 760 gausses, and the magnetized width of the third magnetic pole S12 is approximately 21 degrees.

In addition, an angle, which is between a line which connects a position where the magnetic flux density in the normal line direction of the first magnetic pole S11 becomes a maximum value to the rotational center of the second developing roller 23*a*2 and a line F3 which connects a position where the magnetic flux density in the normal line direction of the second magnetic pole N11 becomes a maximum value to the rotational center of the second developing roller 23*a*2, is approximately 55 degrees. In addition, an angle, which is between the line F3 and a virtual line F2 (second virtual line) which connects a position where the magnetic flux density in the normal line direction of the third magnetic pole S12 becomes a maximum value to the rotational center of the second developing roller 23a2, is approximately 75 degrees.

In the first embodiment of the present invention, a virtual line F1 (first virtual line), which connects the rotational center of the second developing roller 23a2 to the rotational center of the toner carrier capturing roller 23k, passes through a region between positions R1 and R2. At the position R1, the magnetic flux density in the normal line direction of the third magnetic pole S12 becomes a minimum value on the second developing roller 23a2 at the upstream side in the rotating direction of the second developing roller 23a2. At the position R2, the magnetic flux density in the normal line direction of the third magnetic pole S12 becomes a maximum value on the second developing roller 23a2 at the upstream side in the rotating direction of the second developing roller 23a2. That is, the nearest position between the second developing roller 23a2 and the toner carrier capturing roller 23k on the second developing roller 23a2 is at the upstream side from the position where the magnetic flux density in the normal line direction of the third magnetic pole S12 becomes the maximum value in the magnetic force distribution of the third magnetic pole S12.

While the developer G (the toner carriers C) captured by the toner carrier capturing roller 23k approaches the nearest position, the magnetic force from the third magnetic pole S12 to be applied to the developer G becomes gradually large, and the developer G is smoothly transferred onto the second developing roller 23a2. That is, almost all the developer G on the toner carrier capturing roller 23k captured from the photosensitive drum 21 is transferred onto the second developing roller 23a2 before reaching the scraper 23m.

Therefore, in a high-speed image forming apparatus, even if the amount of the developer G (the toner carriers C) to be captured by the toner carrier capturing roller 23k becomes large, almost all the developer G on the toner carrier capturing roller 23k is transferred onto the second developing roller 23a2 and an amount to be scraped by the scraper 23m becomes small. Consequently, the amount of the developer G which is not scraped by the scraper 23m becomes small, and the wear of the scraper 23m can be lowered. In addition, an abnormal image due to short capture of the developer G by the toner carrier capturing roller 23k can be prevented.

It is preferable that an angle θ, between the first virtual line F1 and the second virtual line F2, which connects the position R2 where the magnetic flux density in the normal line direction of the third magnetic pole S12 becomes the maximum value on the second developing roller 23a2 to the rotational center of the second developing roller 23a2, be 1.97 degrees or more. When the angle θ satisfies the above angle, the carrier transferability in which the developer G transfers from the toner carrier capturing roller 23k onto the second developing roller 23a2 can be increased.

Elements N21 and S21 shown in FIG. 8 are described below.

FIG. 9 is a table showing the results of an experiment in which a relationship between the carrier transferability and the angle θ is shown.

In the experiment, three developing devices No. 1, No. 2, and No. 3 are used in which the magnetic force distributions of the toner carrier capturing roller 23k are different. In a first magnetic pole (main magnetic pole) N21 of the toner carrier capturing roller 23k of the three developing devices No. 1 through No. 3, the magnetic flux densities are 775, 790, and 777 gausses, respectively, the magnetized widths are 19.3, 19.4, and 19.6 degrees, respectively, and the magnetic polar positions are 90.1, 91.6, 91.2 degrees, respectively. In addition, in the three developing devices No. 1 through No. 3, the magnetic flux densities of a second magnetic pole S21 of the toner carrier capturing roller 23k are 78, 80, and 74 gausses, respectively. Then the position of the toner carrier capturing roller 23k for the second developing roller 23a2 is shifted, that is, the angle θ is shifted, and the carrier transferability is visually evaluated. The first and second magnetic poles N21 and S21 are described below in detail.

In FIG. 9, "o" shows that the carrier transferability is good and the developer G (the toner carriers C) does not remain on the toner carrier capturing roller 23k passed through a position facing the second developing roller 23a2, "Δ" shows that the carrier transferability is within tolerance and a small amount of the developer G (the toner carriers C) remains on the toner carrier capturing roller 23k passed through the position facing the second developing roller 23a2, and "×" shows that the carrier transferability is not good and the developer G (the toner carriers C) remains on the toner carrier capturing roller 23k passed through the position facing the second developing roller 23a2.

As shown in FIG. 9, when the angle θ is determined to be 1.97 degrees or more, the carrier transferability from the toner carrier capturing roller 23k onto the second developing roller 23a2 can be increased.

In addition, in another experiment, when the magnetic polar position of the first magnetic pole S11 is fixed and the position of the peak magnetic force of the magnetic flux density in the normal line direction of the second magnetic pole N11 is shifted in the vertical direction in FIG. 8, the carrier transferability is not changed.

In addition, when the magnetic brush on the second developing roller 23a2 either contacts or does not contact the toner carrier capturing roller 23k, the carrier transferability shows a result similar to that shown in FIG. 9.

In the first embodiment of the present invention, the first and second magnetic poles N21 and S21 are generated at positions surrounding the toner carrier capturing roller 23k by the built-in magnet. The first magnetic pole N21 is a main magnetic pole (N pole) generated at the side to face the photosensitive drum 21 and transfers the developer G (the toner carriers C) adhered on the photosensitive drum 21 onto the toner carrier capturing roller 23k.

The second magnetic pole S21 is a developer drawing apart pole generated at the downstream side of the first magnetic pole N21 and transfers the developer G captured by the toner carrier capturing roller 23k onto the second developing roller 23a2 by drawing apart the developer G from the toner carrier capturing roller 23k. It is preferable that the magnetic flux density in the normal line direction of the second magnetic pole S21 be 150 gausses or less. With this, the developer G on the toner carrier capturing roller 23k can be smoothly transferred onto the second developing roller 23a2 without being influenced by the magnetic force of the second magnetic pole S21.

In the first embodiment of the present invention, the maximum value of the magnetic flux density in the normal line direction of the first magnetic pole N21 is approximately 780 gausses, and the magnetized width of first magnetic pole N21 is approximately 18 degrees. In addition, the maximum value of the magnetic flux density in the normal line direction of the second magnetic pole S21 is 78 to 94 gausses.

Actually, plural magnetic poles are generated at positions surrounding the first developing roller 23a1 by the built-in magnet; however, since the plural magnetic poles do not directly relate to the present embodiment, the description is omitted.

As described above, in the first embodiment of the present invention, since the position of the toner carrier capturing roller 23*k* is optimized for the position of the second developing roller 23*a*2, the developer G (the toner carriers C) captured by the toner carrier capturing roller 23*k* is smoothly transferred onto the second developing roller 23*a*2 by the third magnetic pole S12. Therefore, lowering the amount of the developer G to be captured by the toner carrier capturing roller 23*k* with the passage of time can be surely prevented.

In the first embodiment of the present invention, the developing device 23 includes the three developer carrying sections B1, B2, and B3; however, the number of the developer carrying sections is not limited to three, and can be two, or four or more.

In addition, in the first embodiment of the present invention, the third developer carrying screw 23*b*3 is disposed slanted from the horizontal direction; however, the third developer carrying screw 23*b*3 can be disposed in the horizontal direction.

In addition, in the first embodiment of the present invention, the agent cartridge 28 supplies the developer G (the toners T and the toner carriers C) to the developing device 23; however, the agent cartridge 28 can supply only the toner carriers C to the developing device 23. In this case, a toner cartridge storing only the toners T is additionally provided, and the toners T are supplied to the developing device 23 from the toner cartridge based on a result detected by the magnetic sensor 26.

In addition, in the first embodiment of the present invention, the process cartridge 20 includes the developing device 23 and is detachable from a main body of the image forming apparatus 1; however, the process cartridge 20 is not always needed. Specifically, it is possible that only the developing device 23 is detachable from the main body of the image forming apparatus 1.

In addition, in the first embodiment of the present invention, the developing device 23 includes the first and second developing rollers 23*a*1 and 23*a*2; however, the number of the developing rollers is not limited to two, and can be one or three or more.

Second Embodiment

Referring to the drawings, a second embodiment of the present invention is described. In the second embodiment of the present invention, when a function of an element having a reference number is almost the same as that in the first embodiment, the same reference number is used for the element.

Figure 10:
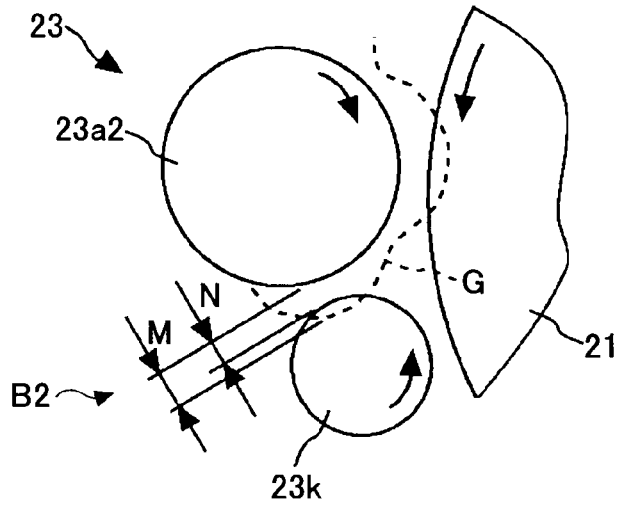
FIG. 10 is an enlarged view of a part of a developing device according to a second embodiment of the present invention.

FIG. 10 is an enlarged view of a part of the developing device 23 according to the second embodiment of the present invention. In FIG. 10, the positions of the second developing roller 23*a*2 and the toner carrier capturing roller 23*k* are mainly shown. In the second embodiment of the present invention, a gap N between the second developing roller 23*a*2 and the toner carrier capturing roller 23*k* is optimized.

In the second embodiment of the present invention, similar to the first embodiment of the present invention, the position of the toner carrier capturing roller 23*k* is optimized for the position of the second developing roller 23*a*2. That is, the position of the toner carrier capturing roller 23*k* is optimized for the position of the third magnetic pole S12 (refer to FIG. 8) of the second developing roller 23*a*2.

As shown in FIG. 10, the gap N between the second developing roller 23*a*2 and the toner carrier capturing roller 23*k* is determined so that the developer G on the second developing roller 23*a*2 contacts the toner carrier capturing roller 23*k* due to the third magnetic pole S12 (refer to FIG. 8).

With this, the magnetic brush of the developer G on the second developing roller 23*a*2 adheres the developer G (the toner carriers C) on the toner carrier capturing roller 23*k* by a scraping manner. Therefore, the carrier transferability from the toner carrier capturing roller 23*k* to the second developing roller 23*a*2 can be further increased.

It is preferable that the gap N be determined to be 55% or more of the height M of the developer G on the second developing roller 23*a*2 due to the third magnetic pole S12 when it is assumed that the toner carrier capturing roller 23*k* is not disposed.

With this, the toners T floating in the second developer carrying section B2 are prevented from being leaked from chinks, for example, chinks at both ends of the second developing roller 23*a*2 in the long length direction. Specifically, in the second developer carrying section B2, a suction air current is generated by a pumping action corresponding to the rotation of the second developing roller 23*a*2, internal pressure becomes extremely higher than external pressure, and the toners T are leaked from the chinks at the ends of the second developing roller 23*a*2 to the outside. In order to avoid the leakage of the toners T, the value N/M (the gap N/the height of the particle clusters M) is determined to be 55% or more.

Figure 11:
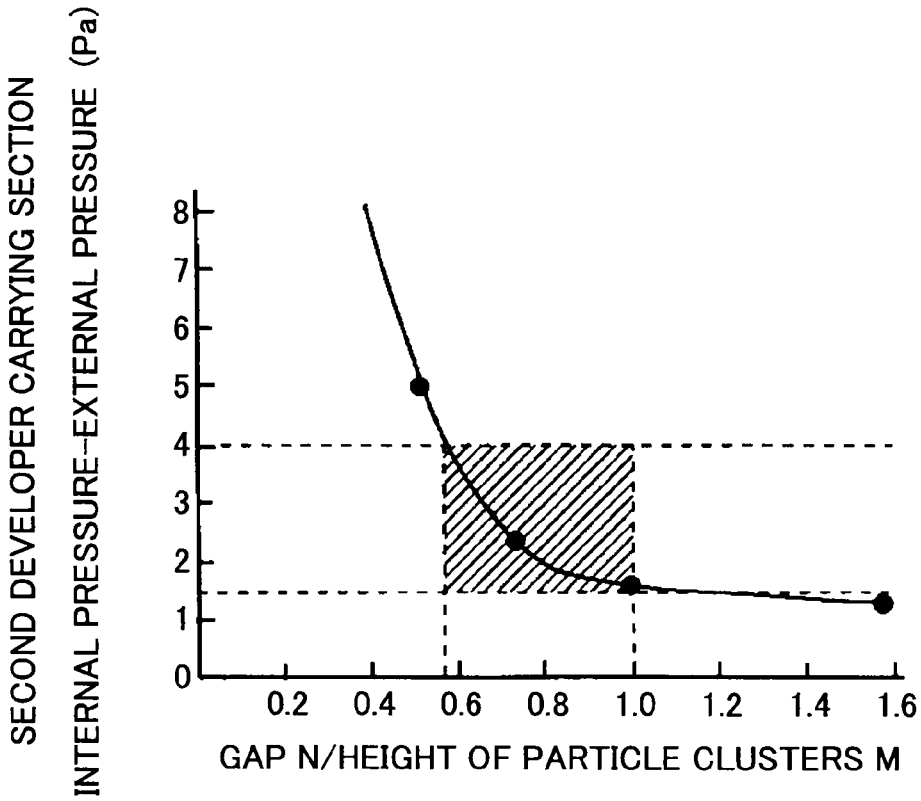
FIG. 11 is a graph showing a relationship between a gap/a height of particle clusters and a pressure difference in a second developer carrying section according to the second embodiment of the present invention.

FIG. 11 is a graph showing a relationship between the gap N/the height of the particle clusters M and the pressure difference (the internal pressure−the external pressure) in the second developer carrying section B2. The graph in FIG. 11 is a result of another experiment when the gap N/the height of the particle clusters M is changed.

In FIG. 11, when the pressure difference (the internal pressure−the external pressure) exceeds 4 Pa, the toners T are leaked from the chinks of the developing device 23 (the second developer carrying section B2). In addition, when the pressure difference becomes less than 1.5 Pa, the toners T are leaked from a space between the second developing roller 23*a*2 and the toner carrier capturing roller 23*k* in the long length direction due to a lack of sufficient suction air current in the second developer carrying section B2.

By the results of the experiment, when the gap N/the height of the particle clusters M is determined to be 55% or more, the toners T are not leaked from the chinks of the developing device 23. In addition, when the gap N/the height of the particle clusters M is determined to be 100% or less, the toners T are not leaked from the space between the second developing roller 23*a*2 and the toner carrier capturing roller 23*k*. That is, in order to prevent the toners T from being leaked from the developing device 23 while maintaining the carrier transferability from the toner carrier capturing roller 23*k* to the second developing roller 23*a*2, it is preferable that the gap N/the height of the particle clusters M be in a range between 55 to 100% (the hatched part in FIG. 11).

When the toners T such as magenta toners, cyan toners, and yellow toners which do not contain carbon black are used, the above toner leakage is likely to occur due to lowering the toner charging ability. Therefore, the above determination of the gap N/the height of the particle clusters M is effective for a developing device using color toners.

As described above, in the second embodiment of the present invention, since the position of the toner carrier capturing roller 23*k* is optimized for the position of the second developing roller 23*a*2, the developer G (the toner carriers C)

captured by the toner carrier capturing roller 23*k* is smoothly transferred onto the second developing roller 23*a*2 by the third magnetic pole S12 while preventing the toner leakage from the developing device 23.

Third Embodiment

Figure 12:
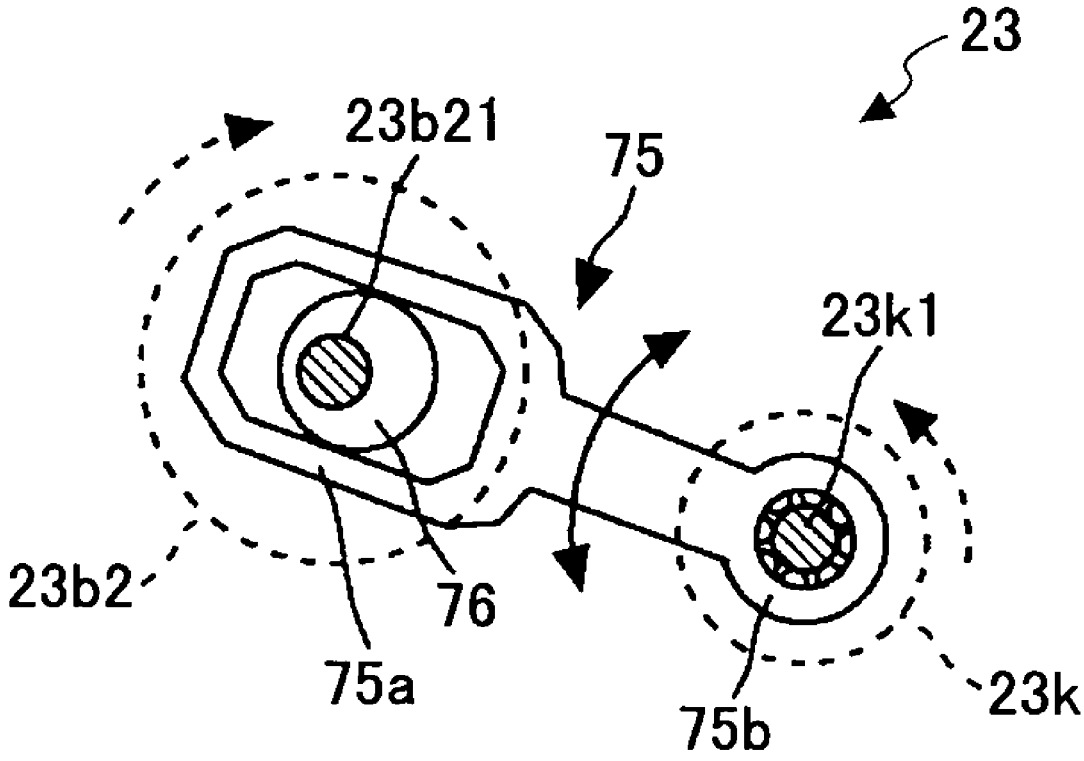
FIG. 12 is a cut-away side view of a part of a developing device according to a third embodiment of the present invention.

Referring to FIG. 12, a third embodiment of the present invention is described. In the third embodiment of the present invention, when a function of an element having a reference number is almost the same as that in the first embodiment, the same reference number is used for the element.

FIG. 12 is a cut-away side view of a part of the developing device 23 according to the third embodiment of the present invention. In the third embodiment of the present invention, the toner carrier capturing roller 23*k* is intermittently driven.

In the third embodiment of the present invention, similar to in the first embodiment of the present invention, the position of the toner carrier capturing roller 23*k* is optimized for the position of the second developing roller 23*a*2 (not shown in FIG. 12).

As shown in FIG. 12, the developing device 23 further includes a swinging member 75 for intermittently driving the toner carrier capturing roller 23*k*.

As shown in FIG. 12, a one-way clutch 75*b* of the swinging member 75 is attached to a shaft 23*k*1 of the toner carrier capturing roller 23*k*. In addition, an eccentric cam 76 is attached to a shaft 23*b*21 of the second developer carrying screw 23*b*2. Further, the eccentric cam 76 is engaged in an engaging section 75*a* of the swinging member 75.

When the second developer carrying screw 23*b*2 is rotated, the swinging member 75 swings, and the toner carrier capturing roller 23*k* connected to the one-way clutch 75*b* is intermittently rotated in the one direction. Specifically, when the second developer carrying screw 23*b*2 is rotated, the eccentric cam 76 slides in the engaging section 75*a* by an eccentric action of the eccentric cam 76, and the swinging member 75 swings in the arrow direction with the one-way clutch 75*b* as the center. Since the one-way clutch 75*b* transfers the rotational force to the toner carrier capturing roller 23*k* only in the one direction, the toner carrier capturing roller 23*k* is intermittently rotated in a predetermined direction (the counterclockwise direction).

When the third embodiment of the present invention is compared with a mechanism in which the rotational force of the second developer carrying screw 23*b*2 is transferred to the toner carrier capturing roller 23*k* by a series of gears, in the third embodiment of the present invention, the decelerating coefficient can be higher than that of the mechanism with a smaller space. Specifically, in the third embodiment of the present invention, the rotational speed of the second developer carrying screw 23*b*2 is 518.5 rpm and the rotational speed of the toner carrier capturing roller 23*k* is 12.7 rpm; that is, the decelerating coefficient is 0.0245.

Therefore, even if the developing device 23 is used in a high-speed image forming apparatus, the toner carrier capturing roller 23*k* can be operated at a relatively low speed. Consequently, the service life of the developing device 23 can be longer than before by lowering the wear of the toner carrier capturing roller 23*k* and the scraper 23*m*.

As described above, in the third embodiment of the present invention, similar to the first and second embodiments of the present invention, since the position of the toner carrier capturing roller 23*k* is optimized for the position of the second developing roller 23*a*2, the developer G (the toner carriers C) captured by the toner carrier capturing roller 23*k* is smoothly transferred onto the second developing roller 23*a*2 by the third magnetic pole S12. Therefore, lowering the amount of the developer G to be captured by the toner carrier capturing roller 23*k* with the passage of time can be surely prevented.

Further, the present invention is not limited to the specifically disclosed embodiments, and variations and modifications may be made without departing from the scope of the present invention. That is, the number, the positions, and shapes of the elements of the present invention are not limited to the specifically disclosed embodiments and can be changed within the scope of the present invention.

The present invention is based on Japanese Priority Patent Application No. 2007-052907, filed on Mar. 2, 2007, with the Japanese Patent Office, the entire contents of which are hereby incorporated herein by reference.

What is claimed is:

1. A developing device which contains developer having toner carrier and toner and develops a latent image formed on an image carrier, comprising:

a developing roller disposed to face the image carrier for carrying the developer by a magnetic force; and a toner carrier capturing roller disposed to face the developing roller for capturing the toner carrier adhered onto the image carrier by a magnetic force; wherein the developing roller generates a magnetic pole at a side facing the toner carrier capturing roller, and a first virtual line, which connects a rotational center of the developing roller to a rotational center of the toner carrier capturing roller, passes through a region between a position where a magnetic flux density of the magnetic pole in a normal line direction is minimum on the developing roller at the upstream side in the rotational direction of the developing roller and a position where the magnetic flux density of the magnetic pole in the normal line direction is maximum on the developing roller.

2. The developing device as claimed in claim 1, wherein:

an angle between the first virtual line and a second virtual line which connects the position where the magnetic flux density of the magnetic pole in the normal line direction is maximum on the developing roller to the rotational center of the developing roller is 1.97 degrees or more.

3. The developing device as claimed in claim 1, wherein:

the developing roller and the toner carrier capturing roller are disposed so that the developer carried on the developing roller by the magnetic force of the magnetic pole contacts the surface of the toner carrier capturing roller.

4. The developing device as claimed in claim 3, wherein:

a gap between the developing roller and the toner carrier capturing roller is 55% or more and 100% or less of a height of the developer carried on the developing roller generated by the magnetic pole when that the toner carrier capturing roller is not disposed.

5. The developing device as claimed in claim 1, wherein:

a magnetic flux density of a magnetic pole of the toner carrier capturing roller in the normal line direction facing the developing roller is 150 gausses or less.

6. The developing device as claimed in claim 4, wherein:

the toner in the developer do not contain carbon black.

7. The developing device as claimed in claim 1, further comprising:

a swinging member having a one-way clutch connected to the toner carrier capturing roller which swinging member swings due to a rotational force of a rotating member disposed in the developing device.

8. A process cartridge detachable from a main body of an image forming apparatus, comprising:

an image carrier on which a latent image is formed; and a developing device which contains developer having toner carriers and toners and develops the latent image formed on the image carrier; wherein the developing device includes a developing roller disposed to face the image carrier for carrying the developer by a magnetic force; and a toner carrier capturing roller disposed to face the developing roller for capturing the toner carriers adhered onto the image carrier by a magnetic force;

the developing roller generates a magnetic pole at a side facing the toner carrier capturing roller, and a first virtual line, which connects a rotational center of the developing roller to a rotational center of the toner carrier capturing roller, passes through a region between a position where a magnetic flux density of the magnetic pole in a normal line direction is minimum on the developing roller at the upstream side in the rotational direction of the developing roller and a position where the magnetic flux density of the magnetic pole in the normal line direction is maximum on the developing roller.

9. The process cartridge as claimed in claim 8, wherein:

an angle between the first virtual line and a second virtual line which connects the position where the magnetic flux density of the magnetic pole in the normal line direction is maximum on the developing roller to the rotational center of the developing roller is 1.97 degrees or more.

10. The process cartridge as claimed in claim 8, wherein:

the developing roller and the toner carrier capturing roller are disposed so that the developer carried on the developing roller by the magnetic force of the magnetic pole contacts the surface of the toner carrier capturing roller.

11. The process cartridge as claimed in claim 10, wherein:

a gap between the developing roller and the toner carrier capturing roller is 55% or more and 100% or less of a height of the developer carried on the developing roller generated by the magnetic pole when it is assumed that the toner carrier capturing roller is not disposed.

12. The process cartridge as claimed in claim 8, wherein:

a magnetic flux density of a magnetic pole of the toner carrier capturing roller in the normal line direction facing the developing roller is 150 gausses or less.

13. The process cartridge as claimed in claim 8, wherein:

the developing device further includes a swinging member having a one-way clutch connected to the toner carrier capturing roller which swinging member swings due to a rotational force of a rotating member disposed in the developing device.

14. An image forming apparatus which forms an image on a recording medium, comprising:

a process cartridge detachable from a main body of the image forming apparatus;

wherein the process cartridge includes an image carrier on which a latent image is formed; and a developing device which contains developer having toner carriers and toners and develops the latent image formed on the image carrier;

the developing device includes a developing roller disposed to face the image carrier for carrying the developer by a magnetic force; and a toner carrier capturing roller disposed to face the developing roller for capturing the toner carriers adhered onto the image carrier by a magnetic force;

the developing roller generates a magnetic pole at a side facing the toner carrier capturing roller, and a first virtual line, which connects a rotational center of the developing roller to a rotational center of the toner carrier capturing roller, passes through a region between a position where a magnetic flux density of the magnetic pole in a normal line direction is minimum on the developing roller at the upstream side in the rotational direction of the developing roller and a position where the magnetic flux density of the magnetic pole in the normal line direction is maximum on the developing roller.

15. The image forming apparatus as claimed in claim 14, wherein:

an angle between the first virtual line and a second virtual line which connects the position where the magnetic flux density of the magnetic pole in the normal line direction is maximum on the developing roller to the rotational center of the developing roller is 1.97 degrees or more.

16. The image forming apparatus as claimed in claim 14, wherein:

the developing roller and the toner carrier capturing roller are disposed so that the developer carried on the developing roller by the magnetic force of the magnetic pole contacts the surface of the toner carrier capturing roller.

17. The image forming apparatus as claimed in claim 16, wherein:

a gap between the developing roller and the toner carrier capturing roller is 55% or more and 100% or less of a height of the developer carried on the developing roller generated by the magnetic pole when it is assumed that the toner carrier capturing roller is not disposed.

18. The image forming apparatus as claimed in claim 14, wherein:

a magnetic flux density of a magnetic pole of the toner carrier capturing roller in the normal line direction facing the developing roller is 150 gausses or less.

19. The image forming apparatus as claimed in claim 17, wherein:

the toners in the developer do not contain carbon black.

20. The image forming apparatus as claimed in claim 14, wherein:

the developing device further includes a swinging member having a one-way clutch connected to the toner carrier capturing roller which swinging member swings due to a rotational force of a rotating member disposed in the developing device.

* * * * *